US009884237B2

(12) United States Patent
Wang et al.

(10) Patent No.: US 9,884,237 B2
(45) Date of Patent: Feb. 6, 2018

(54) BICYCLE TRAINER

(71) Applicant: GIANT MANUFACTURING CO., LTD., Taichung (TW)

(72) Inventors: Chih-Kai Wang, Kaohsiung (TW); Wen-Hai Lo, Miaoli County (TW)

(73) Assignee: Giant Manufacturing Co., Ltd., Taichung (TW)

( * ) Notice: Subject to any disclaimer, the term of this patent is extended or adjusted under 35 U.S.C. 154(b) by 0 days.

(21) Appl. No.: 14/570,635

(22) Filed: Dec. 15, 2014

(65) Prior Publication Data

US 2016/0096098 A1 Apr. 7, 2016

(30) Foreign Application Priority Data

Oct. 1, 2014 (TW) ..... 103217501 U

(51) Int. Cl.
*A63B 69/16* (2006.01)
*A63B 23/04* (2006.01)

(52) U.S. Cl.
CPC ..... *A63B 69/16* (2013.01); *A63B 23/0476* (2013.01); *A63B 2069/165* (2013.01); *A63B 2069/167* (2013.01); *A63B 2225/09* (2013.01)

(58) Field of Classification Search
CPC ..... A63B 2069/164; A63B 2069/165; A63B 69/16
See application file for complete search history.

(56) References Cited

U.S. PATENT DOCUMENTS 4,941,651 A * 7/1990 Phillips ..... A63B 69/16 434/61
6,780,143 B2 8/2004 Copeland
6,945,916 B2 9/2005 Schroeder
8,128,306 B2 * 3/2012 Gorza ..... B62J 1/08 248/354.7

* cited by examiner

*Primary Examiner* — Loan H Thanh
*Assistant Examiner* — Rae Fischer
(74) *Attorney, Agent, or Firm* — Muncy, Geissler, Olds & Lowe, P.C.

(57) ABSTRACT

A bicycle trainer includes a base frame including a first pivot connection part, a damper unit mounted at the base frame, a support frame including a locating portion and a second pivot connection part, which is pivotally connected to the first pivot connection part of the base frame for enabling the support frame to be biased relative to the base frame in direction away from or toward the damper unit such that when the support frame is held in an inclined position relative to the base frame, the locating portion and the damper unit can hold a wheel of a bicycle in place, and a non-return unit mounted at the base frame or support frame and adapted to prohibit the support frame from being biased in direction away from the base frame. The invention enables the support frame to be constrained by the non-return unit.

3 Claims, 13 Drawing Sheets

BICYCLE TRAINER

BACKGROUND OF THE INVENTION

1. Field of the Invention

The present invention relates to bicycle training technology and more particularly, to a bicycle trainer having high structural strength.

2. Description of the Related Art

In order for bicycle riders to exercise cycling without being affected by weather or the environment, the most common way is to set up the bike on a bicycle trainer, enabling the bike to be pedaled indoors to achieve a training effect similar to riding a bike outdoors.

A conventional bicycle trainer, as illustrated in U.S. Pat. No. 6,945,916 (hereinafter called as Patent 916), mainly comprises a U-shaped frame 2 and two legs 3. The legs 3 can be extended out of the bottom side of the U-shaped frame 2 to allow the bicycle trainer to be positioned on the floor. A rear wheel 9 of a bicycle 8 is held in place between two side bars of the U-shaped frame 2, and kept in contact with an impeller unit 100 that provides a damping resistance to achieve training effects. Further, the U-shaped frame 2 and the legs 3 can be folded up to allow the bicycle trainer to be easily stored.

Because the impeller unit 100 of the aforesaid Patent 916 or similar trainer is located at the bottom side of the U-shaped frame 2 and has a relatively heavier magnetic attraction device set located at one lateral side, the center of gravity of the structure is deviated from the center of the U-shaped frame 2, and therefore, there is a problem of trainer bias and being difficult to lift the trainer.

Further, U.S. Pat. No. 6,780,143 (hereinafter called as Patent 143) discloses another design of bicycle trainer, wherein first and second frame members 18, 20 are pivotally connected to each other so that when the second frame member 20 is positioned on the floor, the first frame member 18 can be moved to an operative extended "up" position with respect to the second frame member 20, allowing a rear wheel 38 of a bicycle to be placed between two arcuate end portions 36 of the first frame member 18. When a user rides the bicycle, the body weight of the user and the weight of the bicycle itself can force the wheel-rotating unit 44 and the rear wheel 38 into engagement with each other for cycling exercises.

However, because the aforesaid Patent 143 or similar trainer uses the pivotable, obliquely extended second frame member 20 to hold the rear wheel of the bicycle, the center of gravity of the rider's body will be lifted and moved when the rider pedals the bicycle with much effort to perform, for example, a standstill training or high cadence pedaling training, thus, the second frame member 20 will be abnormally biased toward the first frame member 18, causing the rider unable to steadily pedal the bicycle, and the trainer can fall down suddenly during the exercise.

SUMMARY OF THE INVENTION

The present invention has been accomplished under the circumstances in view. It is the main object of the present invention to provide a bicycle trainer, which has a solid structural strength when in use and, facilitates folding after each use.

To achieve this and other objects of the present invention, a bicycle trainer of the invention is adapted for supporting a wheel of a bicycle. The bicycle trainer comprises a base frame, a damper unit, a support frame, and a non-return unit. The base frame comprises a first pivot connection part. The damper unit is mounted at the base frame. The support frame comprises a second pivot connection part and a locating portion. The second pivot connection part is pivotally connected to the first pivot connection part of the base frame, allowing the support frame to pivot relative to the base frame in direction away from or toward the damper unit. When the support frame is disposed in an oblique position relative to the base frame, the locating portion and the damper unit can hold the wheel of the bicycle in place. The non-return unit can be mounted at the base frame or the support frame to prohibit the support frame from pivoting in a direction away from the base frame.

In one embodiment of the present invention, the non-return unit comprises an engaging member and a fixed member. The engaging member and the fixed member are respectively mounted at one of the support frame and the base frame. The engaging member comprises a cam portion. The fixed member faces toward the cam portion. The cam portion of the engaging member can be selectively moved into engagement with or in direction away from the fixed member. When the cam portion is forced into engagement with the fixed member, the non-return unit prohibits the support frame from pivoting in a direction away from the base frame.

In another embodiment of the present invention, the non-return unit comprises an engagement member and a ratchet member. The engagement member and the ratchet member are respectively mounted at one of the support frame and the base frame. The engagement member is selectively movable relative to the ratchet member into engagement with or in direction away from the ratchet member. When the engagement member is forced into engagement with the ratchet member, the non-return unit prohibits the support frame from pivoting in a direction away from the base frame.

Based on the composition of the aforesaid component parts, the invention enables the support frame to be constrained by the non-return unit, avoiding instability or collapse of the bicycle trainer during application and ensuring a high level of safety during exercises. Further, the user can conveniently fold up the bicycle trainer into a compact condition for storage.

Other advantages and features of the present invention will be fully understood by reference to the following specification in conjunction with the accompanying drawings, in which like reference signs denote like components of structure.

DETAILED DESCRIPTION OF THE INVENTION

Figure 1:
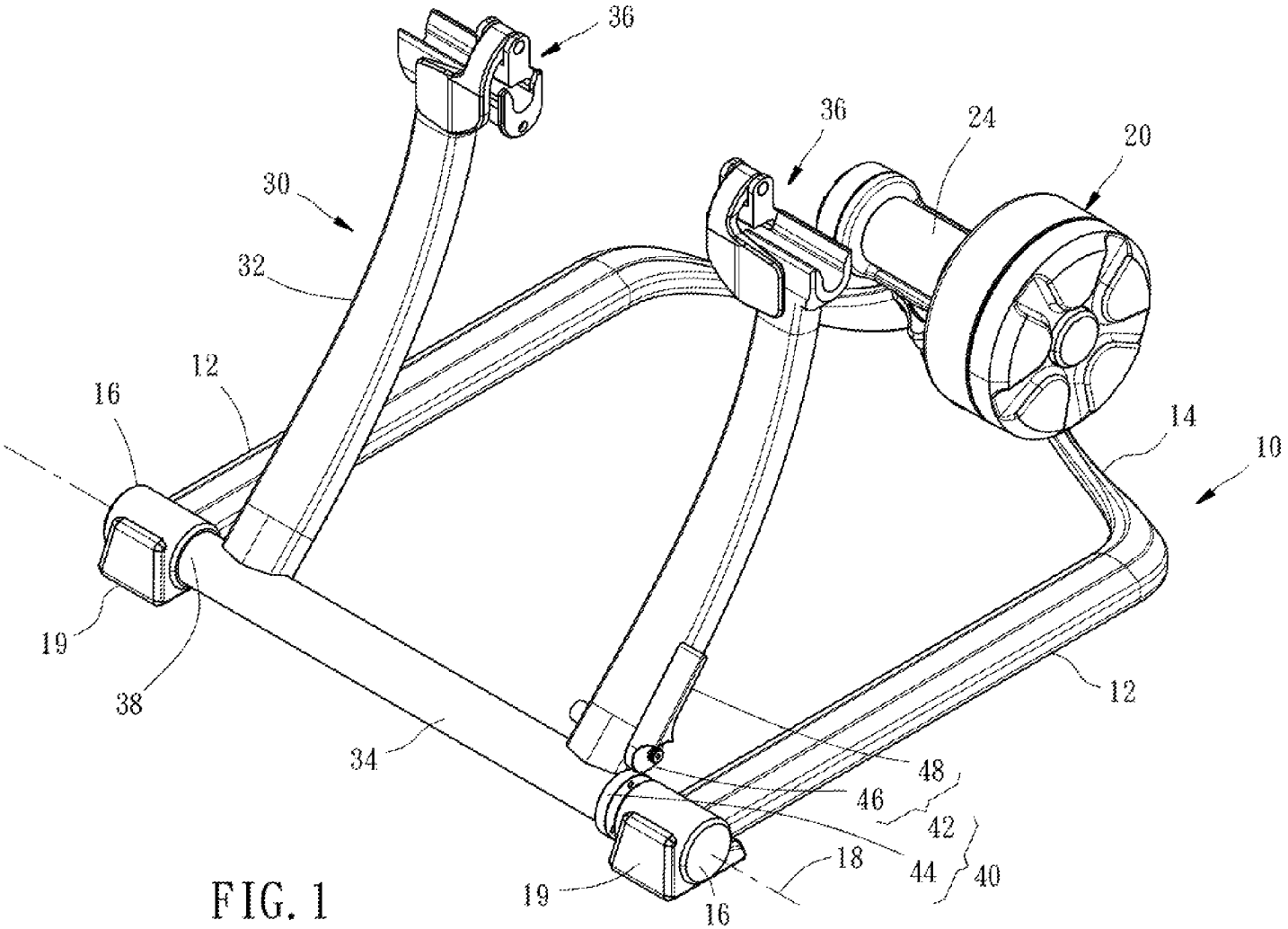
FIG. 1 is an oblique top elevational view of a bicycle trainer in accordance with a first embodiment of the present invention, illustrating a support frame held in an inclined position on a base frame.
Figure 2:
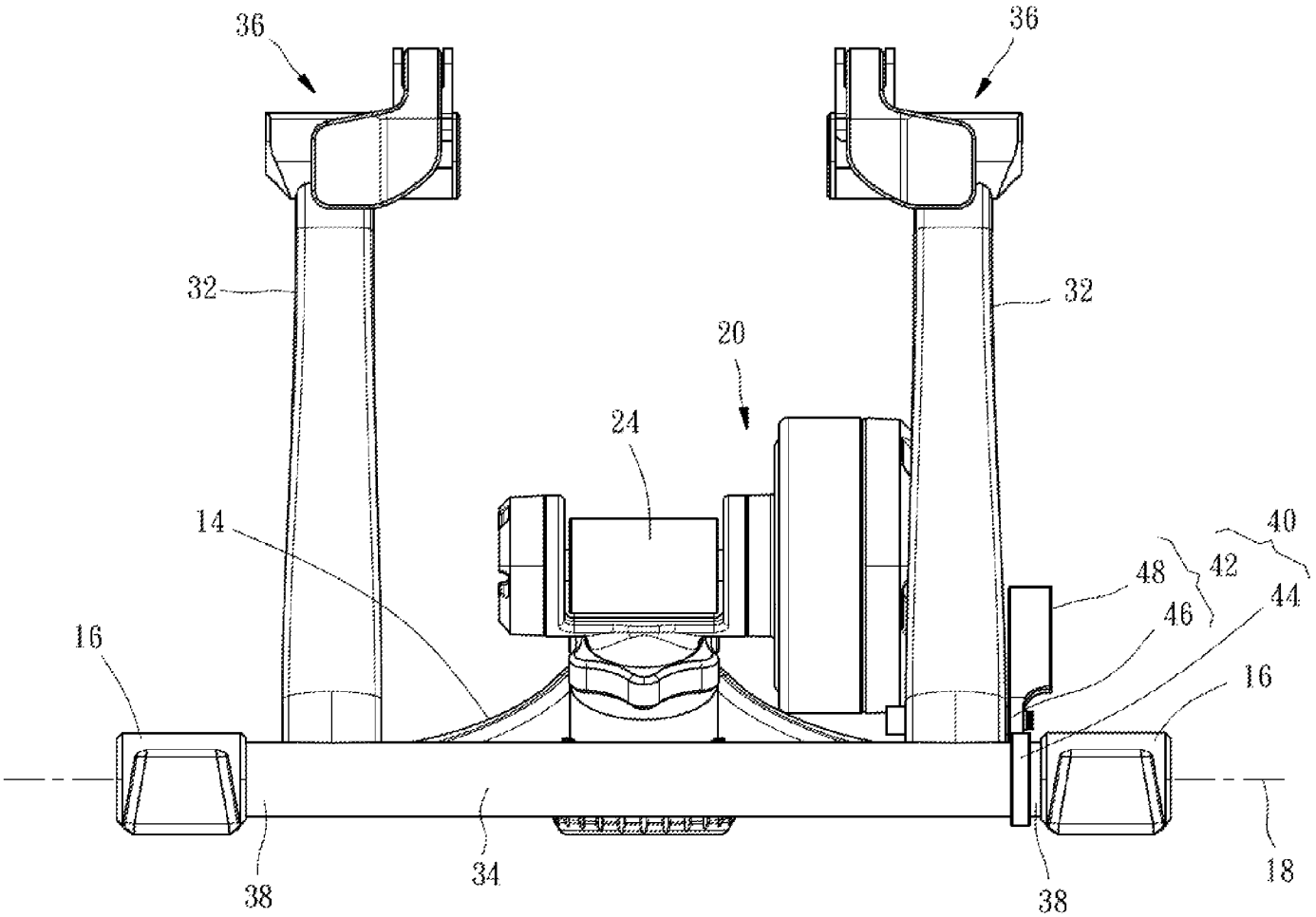
FIG. 2 is a front view of the bicycle trainer in accordance with the first embodiment of the present invention.
Figure 3:
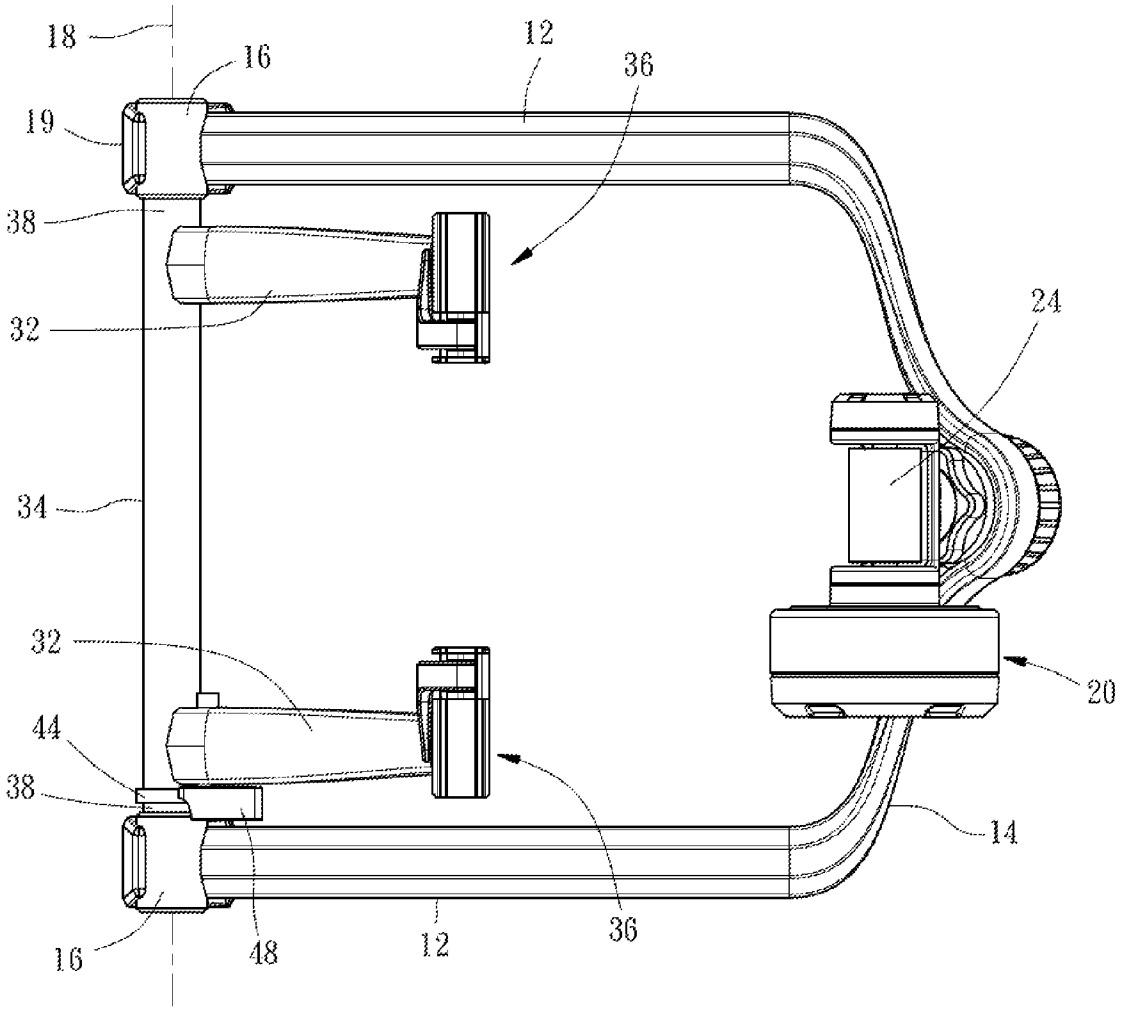
FIG. 3 is a top view of the bicycle trainer in accordance with the first embodiment of the present invention.
Figure 4:
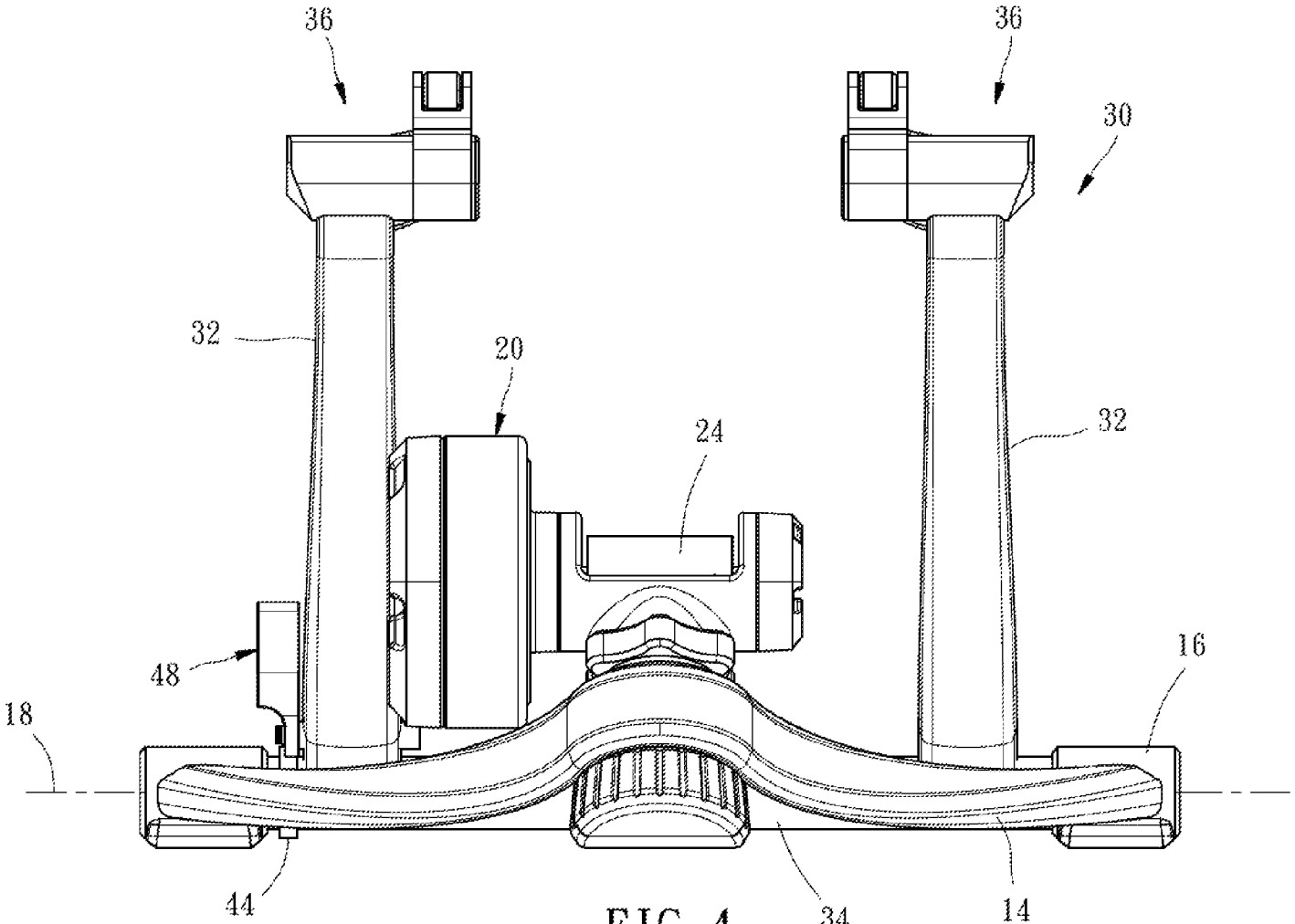
FIG. 4 is a rear view of the bicycle trainer in accordance with the first embodiment of the present invention.

Prior to viewing the following specification in conjunction with the accompanying drawings, it is to be understood that the bicycle trainer of the present invention can be used for bike pedaling training exercises, or simply for supporting a bicycle. Further, the directional terms or similar terms to describe the shape, such as "cylindrical", "circular shaped", "front end", "rear end", "top side", "bottom side" throughout the specification are simply exemplary description languages, not intended for use to limit the scope of the claims.

Referring to FIGS. 1-5, a bicycle trainer in accordance with a first embodiment of the present invention is shown. The bicycle trainer comprises a base frame 10, a damper unit 20, a support frame 30, and a non-return unit 40. The base frame 10 comprises two parallel-spaced first extension portions 12, and a first connection portion 14. Each first extension portion 12 has a first pivot connection part 16 located at a front end thereof. In the present preferred embodiment, the first pivot connection part 16 at each first extension portion 12 is a cylindrical sleeve. The two first pivot connection parts 16 are coaxially extended in a first axial direction 18 substantially in parallel to the ground. The first connection portion 14 extends in integrity between the front ends of the two first extension portions 12 to support the damper unit 20. The base frame 10 has foot members 19 located at a bottom side thereof for positioning on the ground.

Figure 5:
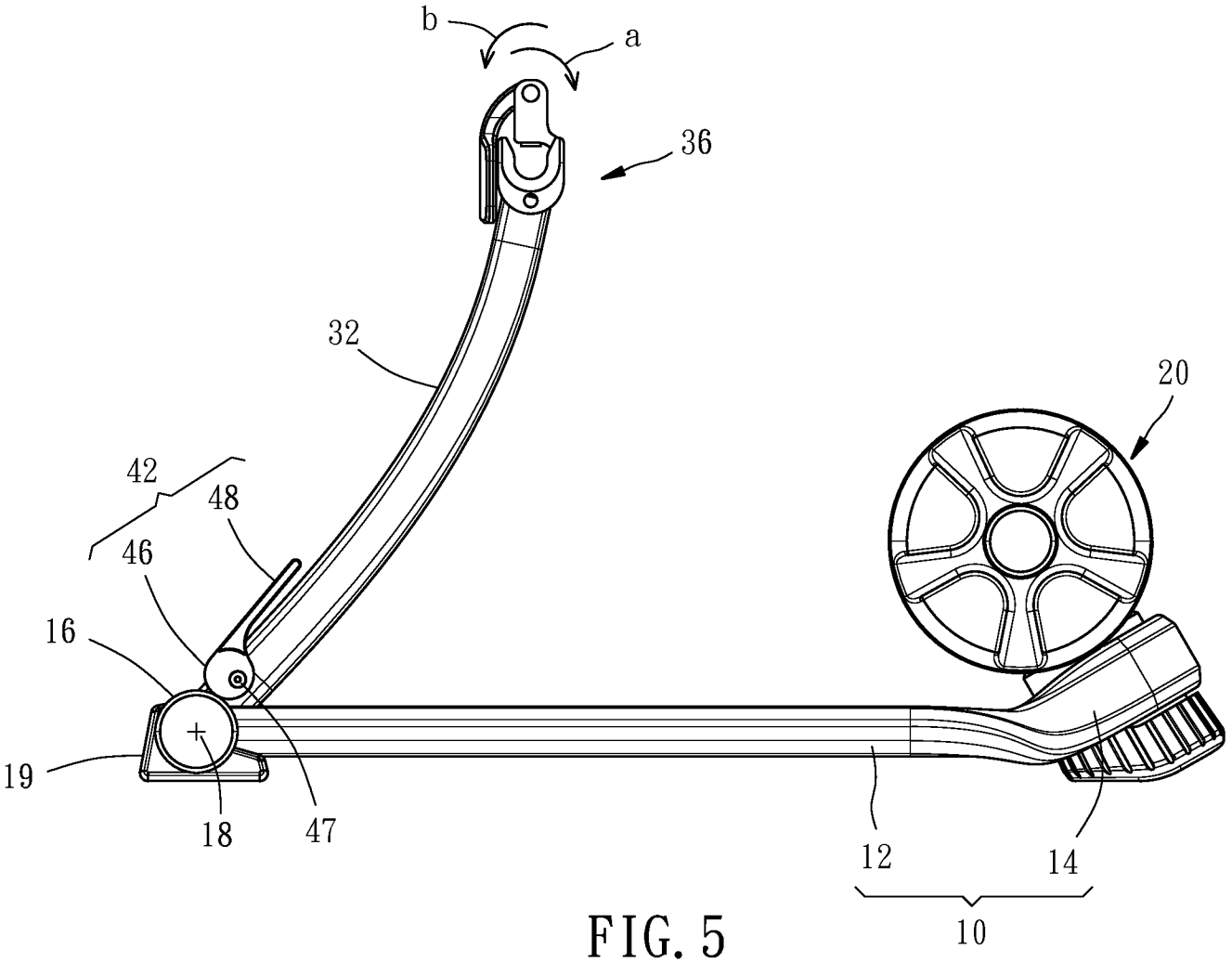
FIG. 5 is a right side view of the bicycle trainer in accordance with the first embodiment of the present invention.

The support frame 30 comprises two long rod-like second extension portions 32 and a second connection portion 34. The two second extension portions 32 are parallel-spaced. The second connection portion 34 is transversely connected between the two second extension portions 32 at a bottom side. Each second extension portion 32 has a locating portion 36 located at a top side thereof for holding a bicycle wheel 1. The second connection portion 34 has a second pivot connection part 38 located at each of two opposite ends thereof. Each second pivot connection part 38 is pivotally connected to one respective first pivot connection part 16 of the base frame 10, allowing the support frame 30 to pivot relative to the base frame 10 in direction away from the damper unit 20 or toward the damper unit 20. As illustrated in FIG. 5, the aforesaid direction away from the damper unit 20 is to turn the support frame 30 about the first axial direction 18 in a counter-clockwise direction b; the aforesaid direction toward the damper unit 20 is to turn the support frame 30 about the first axial direction 18 in a clockwise direction a. When pivot the support frame 30 in direction away from the base frame 10, the support frame 30 will be lifted and held in an oblique position at a predetermined inclined angle relative to the base frame 10, allowing the bicycle wheel 1 to be positioned in between the support frame 30 and the damper unit 20. At this time, the wheel axle 5 of the bicycle wheel 1 is supported in the locating portions 36, and the outer periphery of the bicycle wheel 1 is stopped against one roller set 24 of the damper unit 20. When pivot the support frame 30 toward the base frame 10, the support frame 30 will be received to the base frame 10, keeping the locating portions 36 in proximity to the damper unit 20.

Figure 6:
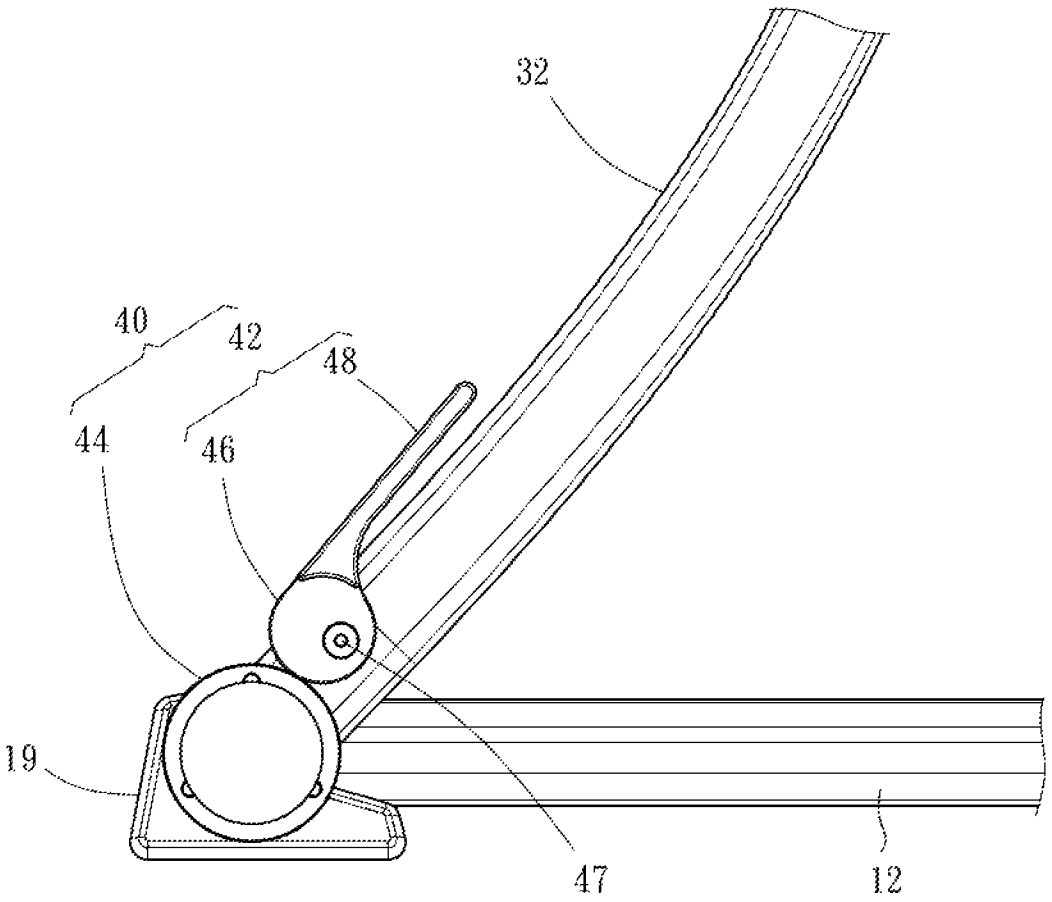
FIG. 6 is an enlarged view of a part of FIG. 5, illustrating the non-return unit stopped against the support frame.

As illustrated in FIG. 5 and FIG. 6, in this first embodiment, the non-return unit 40 is a cam mechanism, however, because the non-return unit 40 is used to prohibit the support frame 30 from pivoting in a direction away from the damper unit 20, the positioning of the non-return unit 40 is not limited to the location described in this embodiment; any arrangement capable to prohibiting the support frame 30 from pivoting in a direction away from the damper unit 20 should be included in the scope of the claims of the present invention.

The non-return unit 40 comprises an engaging member 42 and a fixed member 44. The engaging member 42 comprises a cam portion 46 and an operating portion 48. The cam portion 46 defines a center of rotation 47. The engaging member 42 is pivotally connected with the center of rotation 47 thereof to a bottom side of one second extension portion 32 of the support frame 30 adjacent to the pivot connection between the second pivot connection part 38 and the first pivot connection part 16. The fixed member 44 has a substantially circular shape. Further, the fixed member 44 is mounted at the base frame 10 to face toward the bottom side of the cam portion 46 of the engaging member 42. When the cam portion 46 is moved with the engaging member 42 to have a part of the surface thereof be forced into contact with the fixed member 44, the cam portion 46 is tightly squeezed against the fixed member 44, enabling the engaging member 42 to stop the support frame 30 from pivoting relative to the base frame 10, and thus, the non-return unit 40 can prohibit the support frame 30 from pivoting in a direction away from the base frame 10. Under this technical concept of the present invention, the position of the engaging member 42 and the position of the fixed member 44 can be exchanged, i.e., the same effect can be achieved by mounting one of the engaging member 42 and the fixed member 44 at the support frame 30 and the other at the base frame 10.

Figure 7:
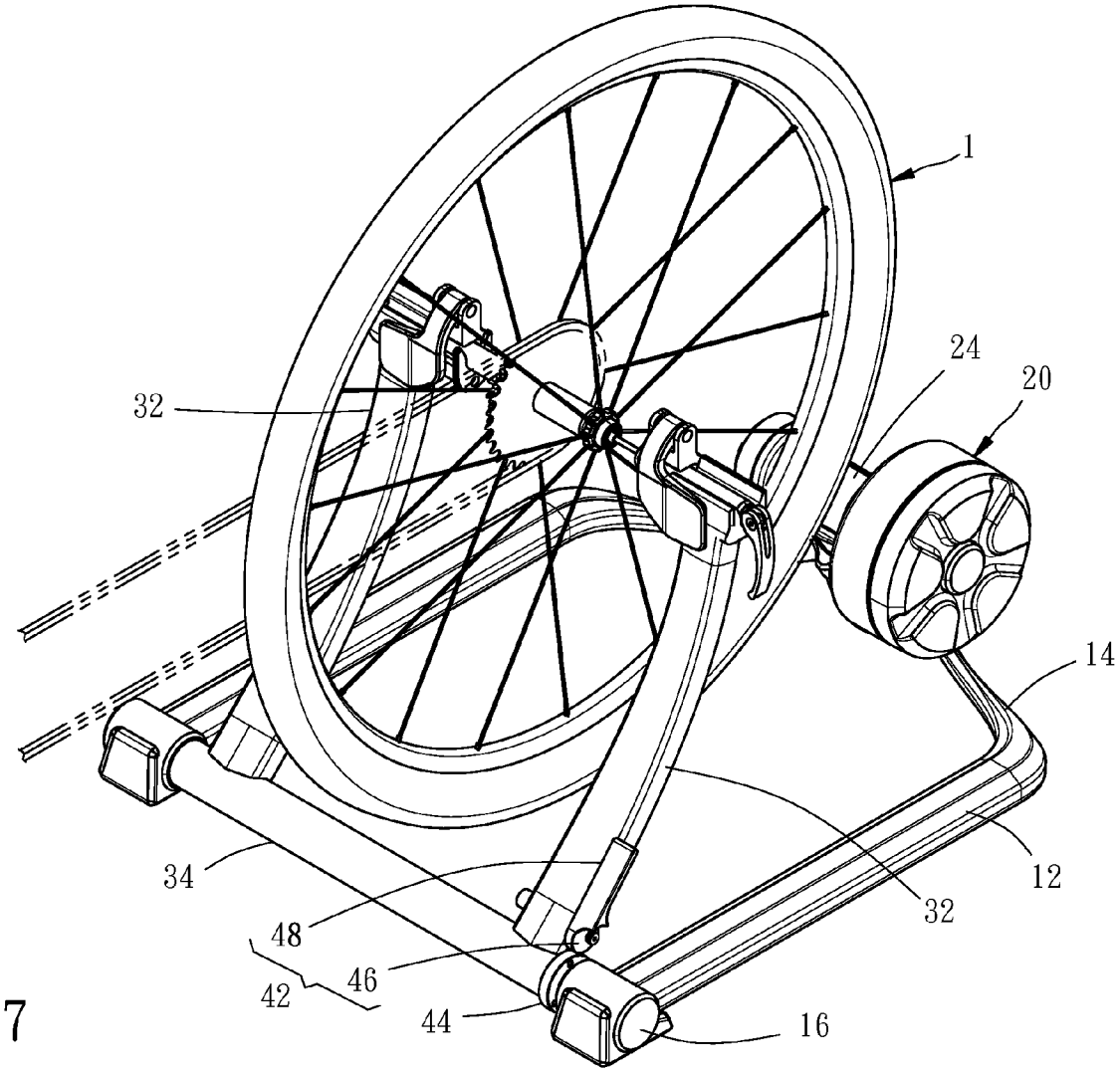
FIG. 7 is a schematic applied view of the bicycle trainer in accordance with the first embodiment of the present invention.
Figure 8:
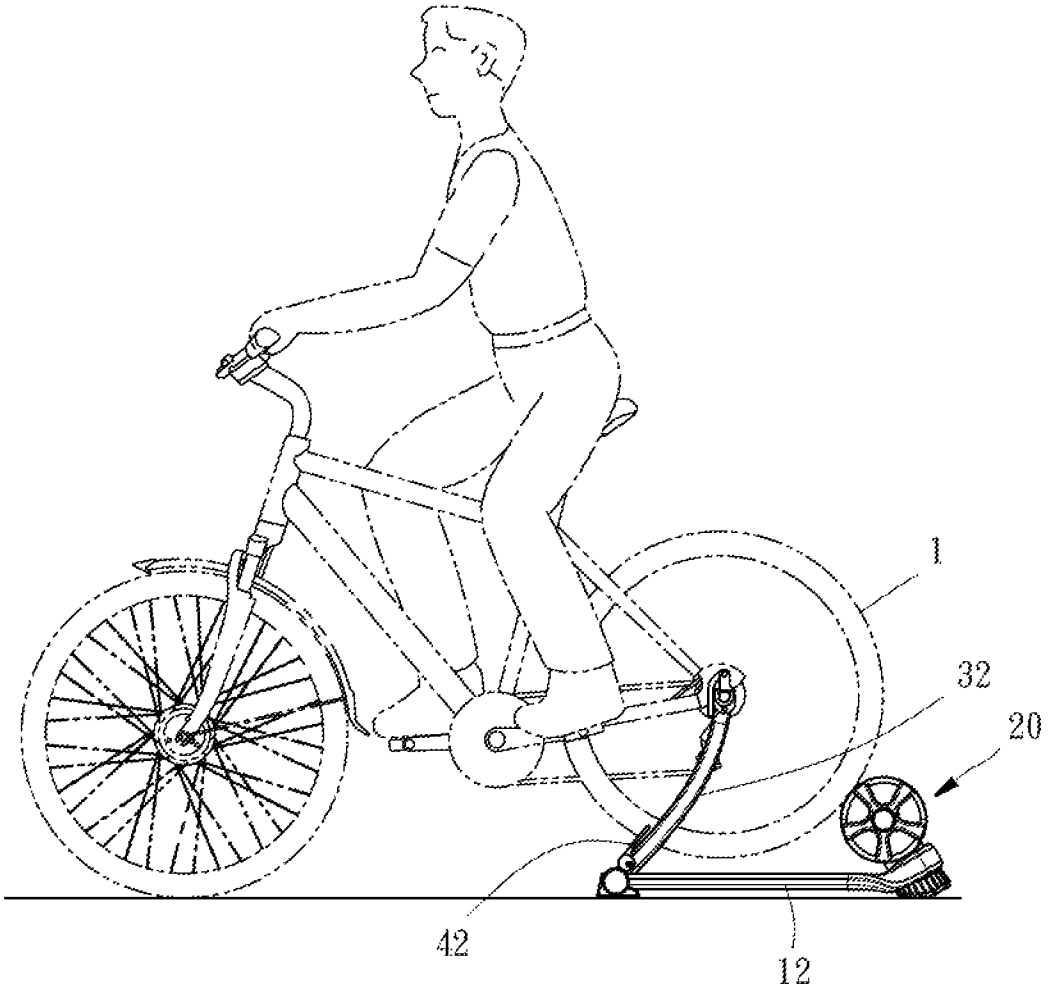
FIG. 8 illustrates another application status of the bicycle trainer in accordance with the first embodiment of the present invention.

According to the above statement to describe the component parts of the bicycle trainer, as illustrated in FIG. 7 and FIG. 8, when the support frame 30 is held in an inclined position between the bicycle wheel 1 and the base frame 10, the two locating portions 36 of the support frame 30 hold the bicycle wheel 1 in place, and the tread of the bicycle wheel 1 is rotatably kept in contact with the damper unit 20, enabling the bicycle wheel 1 to be held down between the support frame 30 and the damper unit 20 by the weight of the rider, and thus the rider can pedal the bicycle in situ. During cycling, the cam portion 46 is directly stopped against the fixed member 44, and therefore, the support frame 30 is prohibited by the non-return unit 40 from pivoting in a direction away from base frame 10. If the rider's body is largely lifted or forwardly moved during cycling, the support frame 30 can still be secured firmly to base frame 10 by the non-return unit 40, avoiding instability or collapse of the bicycle trainer and ensuring exercise safety.

Figure 9:
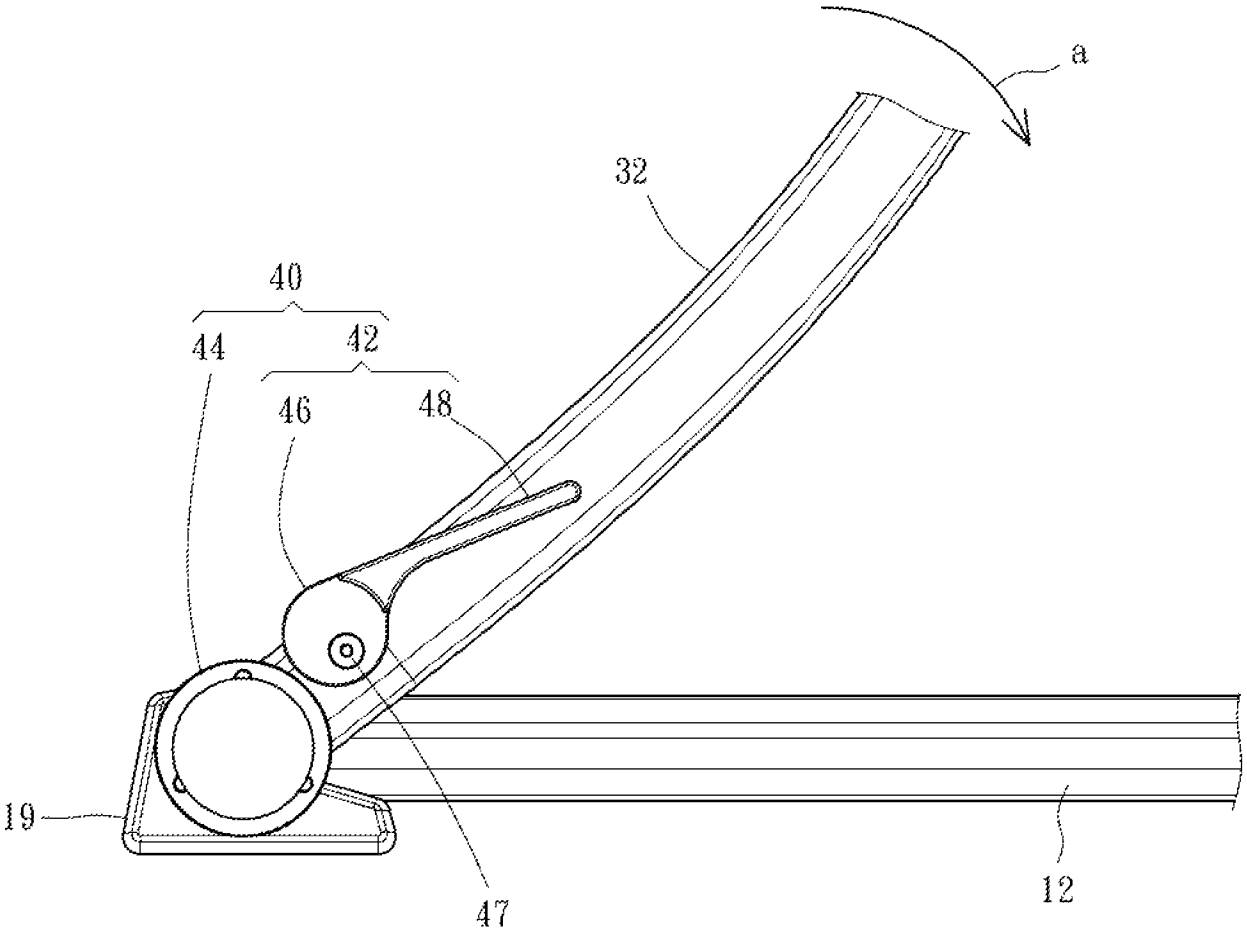
FIG. 9 is similar to FIG. 6, illustrating the support frame released from the constraint of the non-return unit.
Figure 10:
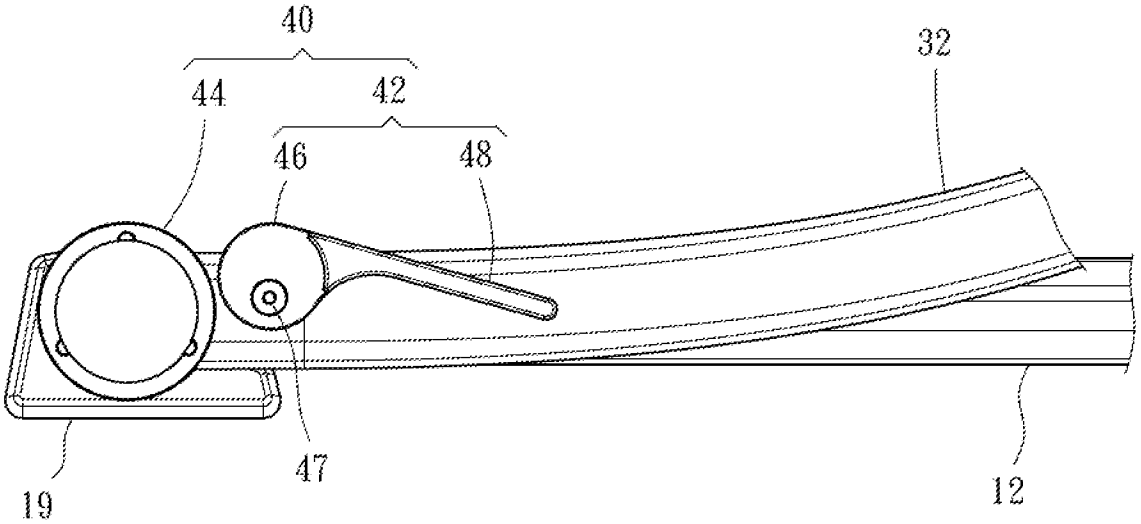
FIG. 10 is similar to FIG. 6, illustrating the support frame released from the constraint of the non-return unit and received to the base frame.
Figure 11:
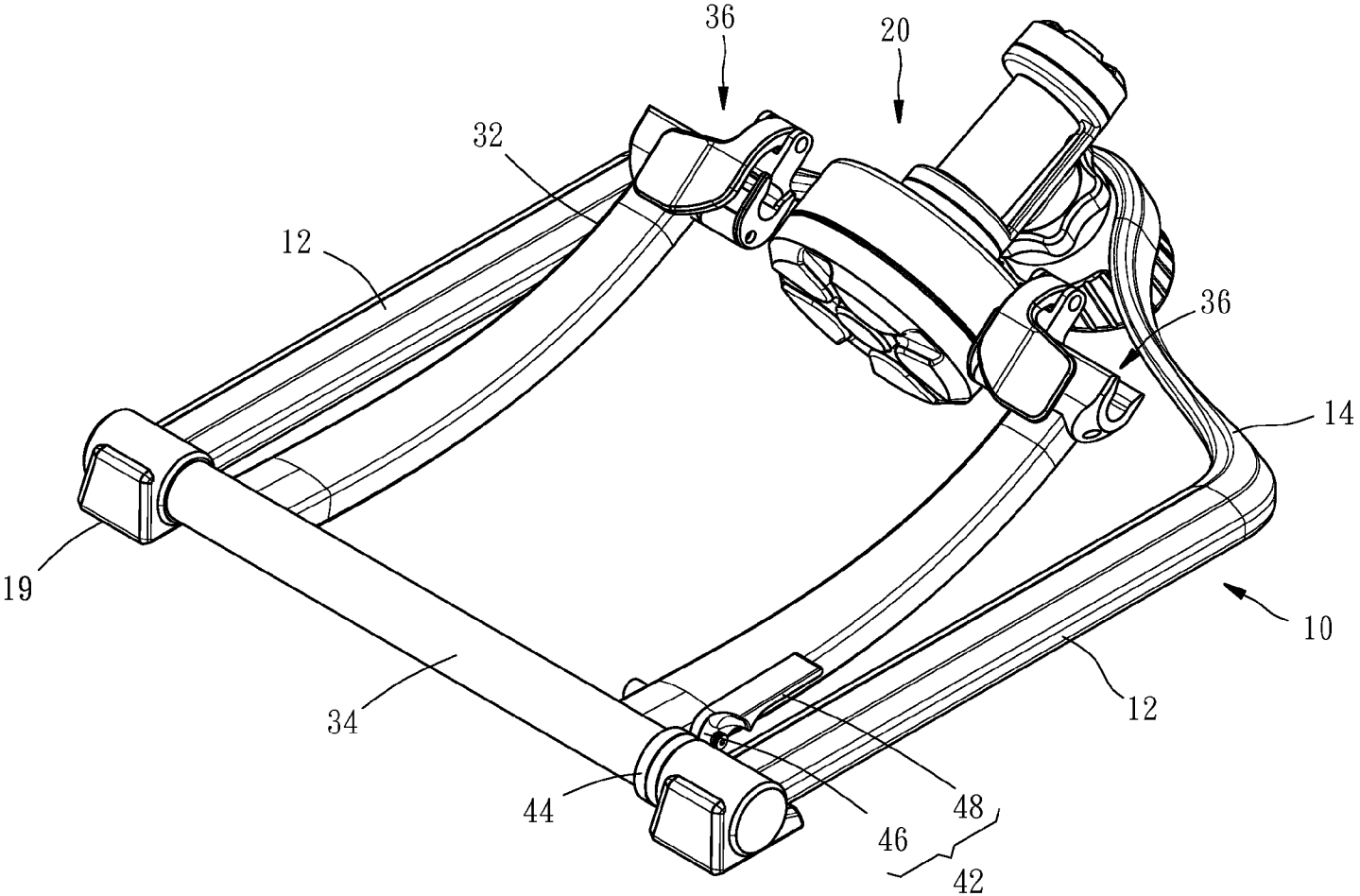
FIG. 11 is similar to FIG. 1, illustrating the support frame received to the base frame.

Referring to FIGS. 9-11, after the exercise is ended and the bicycle wheel 1 is removed from the support frame 30, the user can operate the operating portion 48 of the engaging member 42 to pivot the engaging member 42 to an angle where the cam portion 46 and the fixed member 44 are kept apart. At this time, the support frame 30 is released from the constraint of the engaging member 42 and can be pivot relative to the base frame 10 and then closely attached to the base frame 10 to minimize the dimension of the bicycle trainer, facilitating storage and saving storage space.

Figure 12:
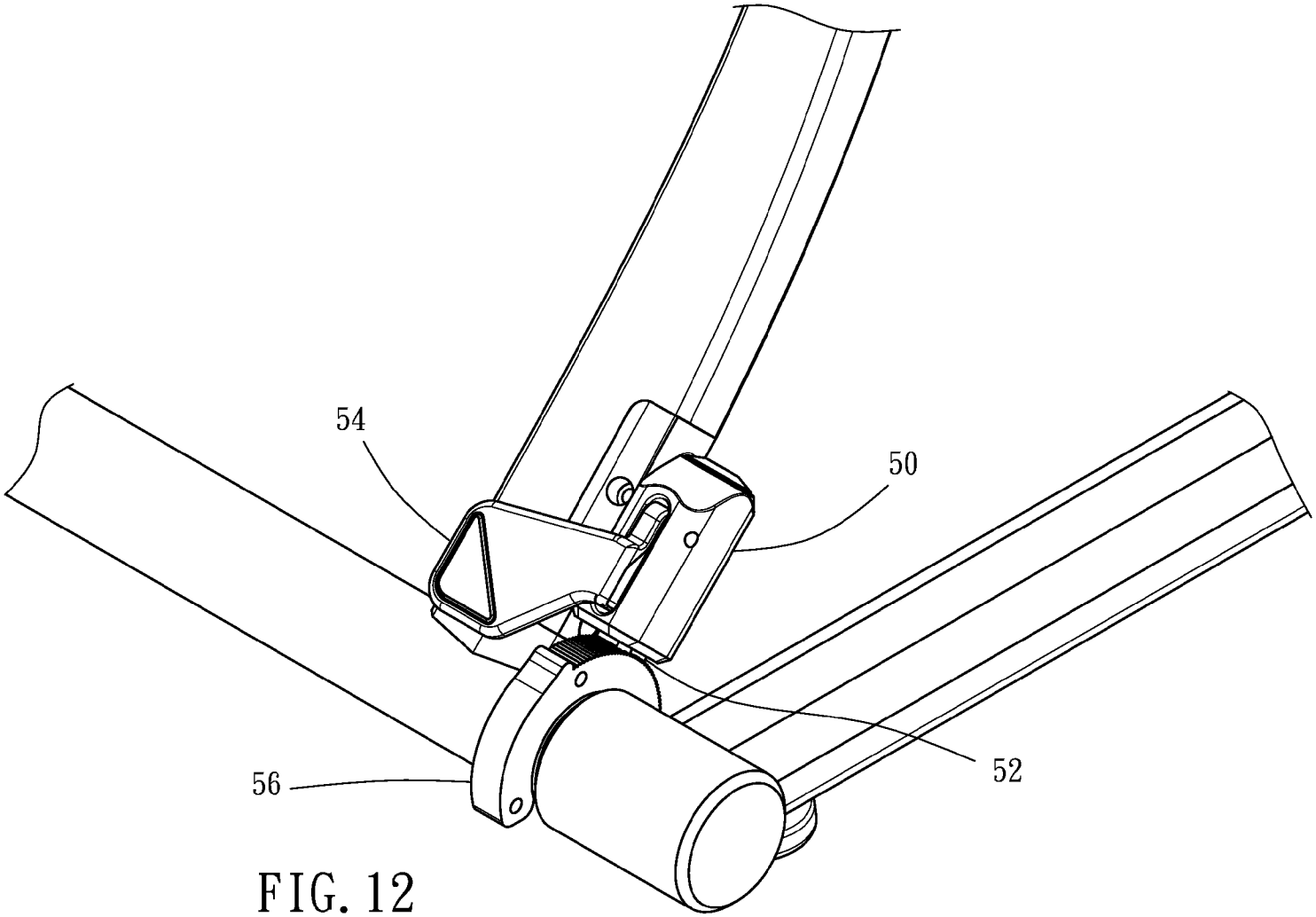
FIG. 12 is an elevational view of a part of a bicycle trainer in accordance with a second embodiment of the present invention, illustrating another alternate form of the non-return unit.
Figure 13:
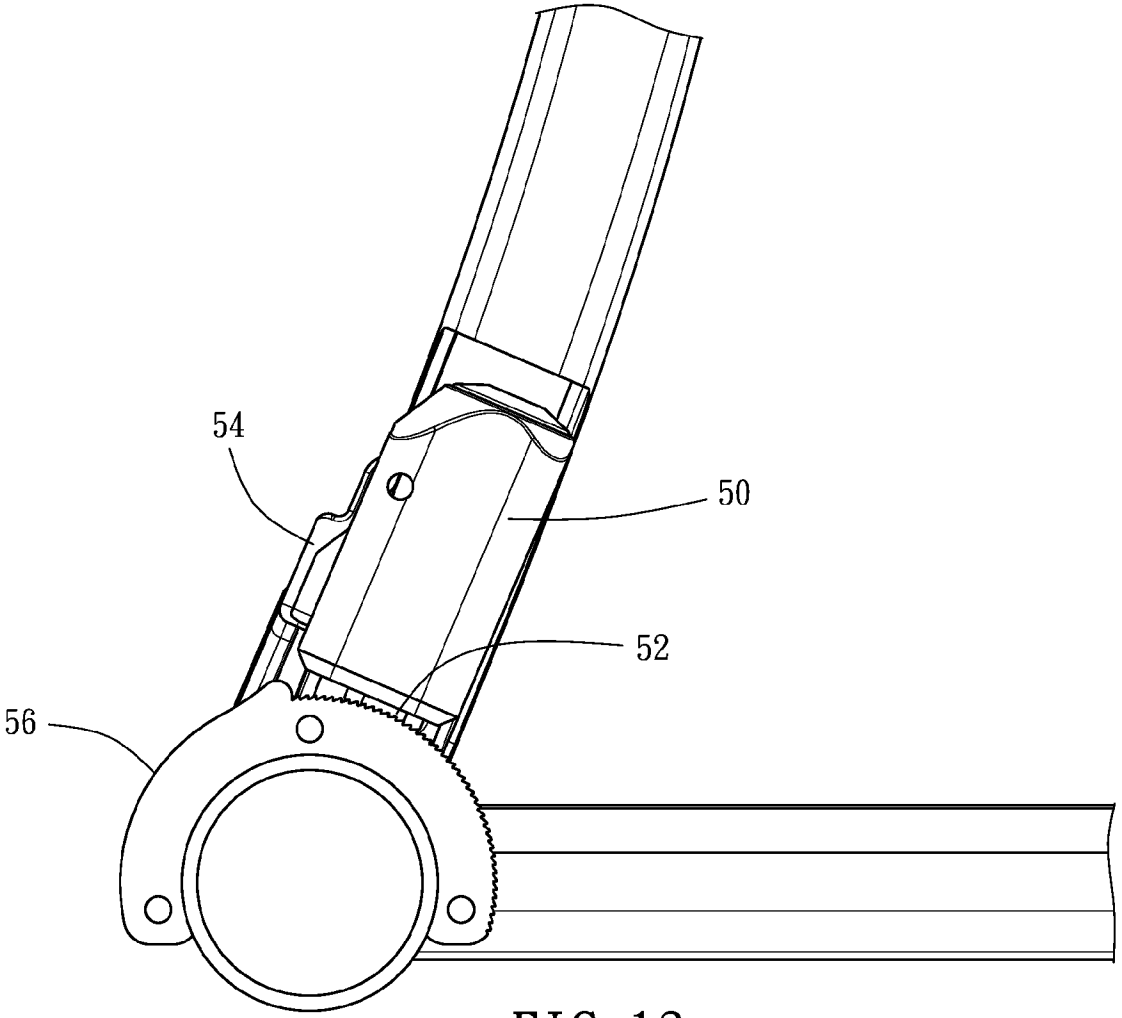
FIG. 13 is a right side view of a part of the bicycle trainer in accordance with the second embodiment of the present invention.

Under the same concept of the present invention, the non-return unit can be alternatively made in the form of a ratchet mechanism. In a second embodiment of the present invention, as illustrated in FIG. 12 and FIG. 13, the non-return unit comprises a holder frame 50, an engagement member 52, a handle 54, and a ratchet member 56. The holder frame 50 is mounted at the bottom side of one second extension portion 32 of the support frame 30. The engagement member 52 is movably mounted inside the holder frame 50. The handle 54 is pivotally mounted at the holder frame 50, and operable to move the engagement member 52 relative to the holder frame 50. Moving the engagement member 52 can engage a toothed bottom side of the engagement member 52 into the ratchet member 56 at the base frame 10, or disengage the toothed bottom side of the engagement member 52 from the ratchet member 56. When the engagement member 52 is forced into engagement with the ratchet member 56, the non-return unit prohibits the support frame from pivoting in a direction away from the base frame 10. When the engagement member 52 is disengaged from the ratchet member 56, the support frame 30 can then be freely pivot relative to the base frame 10. Thus, this second embodiment can achieve the same effects of the aforesaid first embodiment.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A bicycle trainer adapted for supporting a wheel of a bicycle, comprising:

a base frame;

a damper;

a support frame; and a non-return unit, wherein the base frame comprises two first pivot connectors, wherein the damper is mounted to the base frame, wherein the support frame comprises:

two second extensions, each having a locator; and a second connection portion connected between the two second extensions and having two second pivot connectors located at the ends of the second connection portion, wherein the second pivot connectors are pivotally connected to the first pivot connectors to enable the two second extensions to pivot relative to the base frame in direction away from or toward the damper such that, when the support frame is in an inclined position relative to the base frame, the locators and the damper hold the wheel of the bicycle in place, wherein the non-return unit is mounted to the base frame or the support frame and comprises:

a movable member; and a fixed member, wherein the movable member is mounted on and rotates with one of the second extensions and the fixed member is mounted on the base frame, wherein the movable member is configured to prohibit the two second extensions from pivoting in a direction away from the damper, wherein the movable member is configured to stop against the fixed member to limit the rotation of the two second extensions of the support frame, and wherein the two second extensions of the support frame are released from the constraint of the movable member when the movable member is rotated with the two second extensions away from the damper.

2. The bicycle trainer as claimed in claim 1, wherein the movable member comprises a cam, wherein the movable member is configured to pivot causing the cam to be stopped against or moved away from the fixed member, wherein the non-return unit is configured to prohibit the support frame from pivoting away from the base frame when the cam is stopped against the fixed member.

3. The bicycle trainer as claimed in claim 1, wherein the base frame comprises two parallel, spaced-apart first extensions and a first connection portion extending between the first extensions to support the damper, and wherein each first extension terminates at one of the first pivot connectors.

* * * * *